United States Patent [19]

Mester et al.

[11] 3,934,146

[45] Jan. 20, 1976

[54] TIME-MEASURING DEVICE FOR AN X-RAY GENERATOR

[75] Inventors: Heinz Mester; Gerd Vogler, both of Hamburg, Germany

[73] Assignee: U.S. Philips Corporation, New York, N.Y.

[22] Filed: Mar. 15, 1974

[21] Appl. No.: 451,535

[30] Foreign Application Priority Data

Mar. 22, 1973 Germany ..... 2314265

[52] U.S. Cl. ..... 250/402; 250/416

[51] Int. Cl.[2] ..... H05G 1/00

[58] Field of Search ..... 250/402, 403, 408, 413, 250/415, 416, 421

[56] References Cited

UNITED STATES PATENTS 2,668,909 2/1954 Johnston ..... 215/415

*Primary Examiner*—Craig E. Church

*Attorney, Agent, or Firm*—Frank R. Trifari

[57] ABSTRACT

The invention relates to a time-measuring device for an X-ray generator comprising an automatic exposure device. The measurement of the actuation time which is controlled on the primary side by an automatic exposure device is inaccurate because the effect exposure time, which is the time during which the X-ray tube emits the desired radiation, is shorter than the actuation time in the primary circuit. This is due to the fact that, because of the always present stray inductances and cable capacitances etc., the high-voltage on the secondary side can follow the voltage on the primary side only with a given delay. For the accurate measurement of the effective exposure time, therefore, the actuation time is reduced by an amount which is dependent of the exposing tube current.

10 Claims, 3 Drawing Figures

TIME-MEASURING DEVICE FOR AN X-RAY GENERATOR

Figure 1:
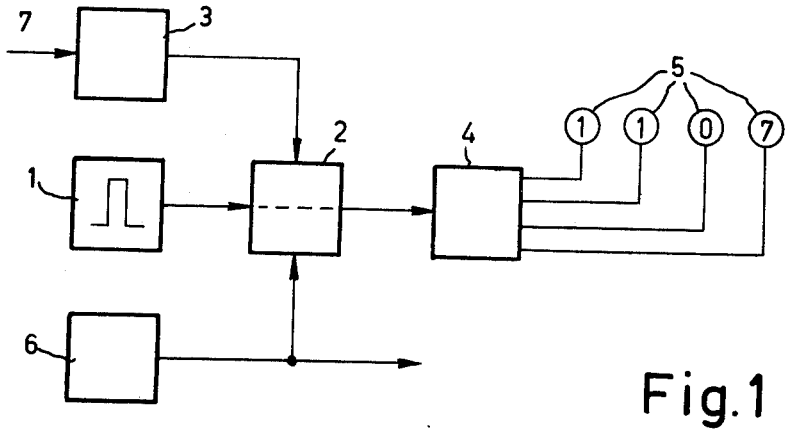

The invention relates to a time-measuring device for an X-ray generator, comprising a switch which is connected in a primary circuit of a transformer for the current supply of an X-ray tube and which is controlled by an automatic exposure device.

The switch in the primary circuit of the transformer for the current supply of the X-ray tube is opened by the automatic exposure device when the latter has measured a given, presettable radiation dose. In the X-ray generators known thus far it is not possible to determine the effective exposure time (this is the time during which the X-ray tube emits the desired radiation) when use is made of an automatic exposure device. However, the physician will often wish to know the effective exposure time. Therefore, an object of the present invention is to provide an X-ray generator of the kind set forth in which, when use is made of an automatic exposure device, the effective exposure time can be exactly measured and displayed, if desired.

According to the invention, a time-measuring device of this kind is characterized in that means are provided for measuring the actuation time, which is reduced by an amount which is dependent on the tube current.

The actuation time (this is the period during which the primary circuit of the transformer for the current supply of the X-ray tube is connected to a supply voltage) in an X-ray generator of the kind set forth is larger than the effective exposure time, because the voltage at the X-ray tube can only follow the voltage in the primary circuit with a given delay because of unavoidable stray inductances, cable capacitances etc., so that the emission of the X-ray tube starts only after the delay following the switching on of the primary voltage. Consequently, the actuation time exceeds the effective exposure time by a given amount (in the order of a few ms).

It was found that the delay at which the X-ray radiation commences after switching on the primary circuit is larger as the tube current to be switched is larger. Because this switch-on delay is not accompanied by an equivalent switch-off delay, at least not in X-ray generators whose primary circuit is switched on and off by means of thyristors, the effective exposure time will be shorter than the actuation time by an amount which is dependent on the tube current. Therefore, according to the invention, the actuation time, reduced by an amount which is dependent of the tube current, is measured, thus providing a correct measurement of the effective exposure time.

The reduction of the actuation time by an amount which is dependent on the tube current can be effected, for example, by means of time-measuring devices comprising a measuring member which supplies a voltage which is proportional to the time expiring after the switching on of the primary voltage in that a voltage which is dependent on the tube current is subtracted from this voltage.

Figure 2:
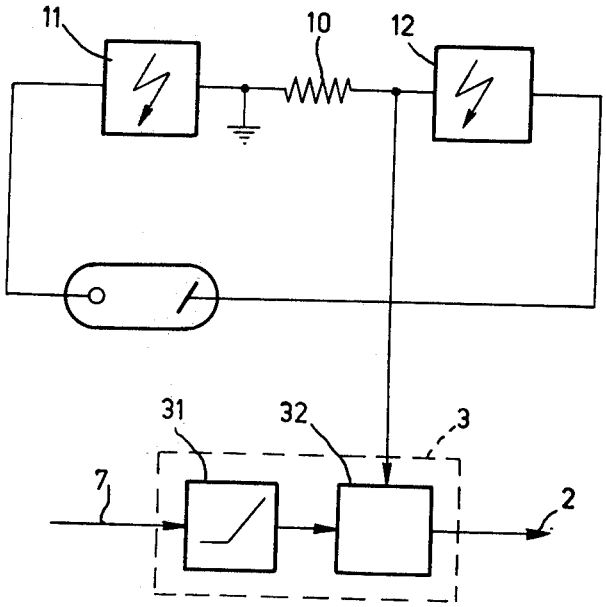
Figure 3:
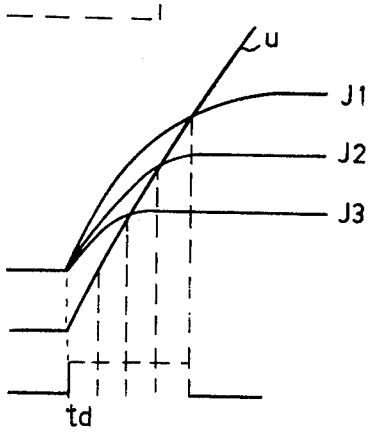

A preferred embodiment of the device according to the invention will be described in detail hereinafter with reference to the drawing in which:

FIG. 1 shows a preferred embodiment of a time-measuring device according to the invention, FIG. 2 shows a preferred embodiment of a correction-time member according to the invention, and FIG. 3 shows a diagram so as to illustrate the operation of the correction-time member shown in FIG. 2.

The time-measuring device which is shown in the form of a block diagram in FIG. 1 comprises a pulse generator 1 which generates pulses of constant frequency (for example, 1 kHz) which are applied to the input of a gate circuit 2. When the gate circuit 2 is open, the pulses of the pulse generator 1 are applied to a counter 4, the position of which can be displayed in known manner by means of digital display tubes 5.

The gate 2 is opened by a start pulse from the correction-time member 3 which itself is controlled by a switch-on pulse, supplied via a line 7, for switching on the supply voltage in the primary circuit of a transformer for the power supply of the X-ray tube. The gate 2 is blocked by a switch-off pulse originating from an automatic exposure device 6. This pulse at the same time opens the switch which is connected in the primary circuit of the transformer for the current supply of the X-ray tube and which is shown in detail, with the result that the exposure is terminated.

The automatic exposure device 6 can in known manner comprise an ionisation chamber or a photomultiplier for the dose measurement, and also switching members which generate the switch-off pulse as soon as a given radiation dose or a given film blackening is reached during the exposure.

The correction-time member (i.e. time delay unit) can comprise, for example, RC elements, the resistance thereof being adjustable by means of the adjusting members for the tube current. During operation of an X-ray generator comprising an automatic exposure device, generally only the voltage can be selected at random, while the current is automatically derived from the chosen focal spot and the chosen voltage. Therefore, the resistances in the RC circuit of the correction-time member 3 must be variable in dependence on the chosen focal spot and of the adjusted voltage, i.e. such that the delay of the start pulse generated by the correction-time member 3 with respect to the switch-on pulse arriving via the line 7 is varied as a function of the tube current, which in turn is determined by the choice of the focal spot and the tube voltage adjustment. By a suitable proportioning of the correction-time member, it can be achieved that the gate 2 is open only for the period during which the desired amount of X-rays is emitted, with the result that the number of pulses which is counted by the counter 4 and displayed by the digital display tubes 5 is proportional to the effective exposure time.

FIG. 2 shows an embodiment of a correction-time member in which the delay between the switch-on pulse and the start pulse is not produced by the adjusting members for the exposure parameters influencing the tube current, but directly in dependence on the measured tube current. For measuring the tube current, a resistor 10, which is grounded on one side, is connected in the high-voltage circuit of an X-ray tube 13, which circuit is diagrammatically represented by the blocks 11 and 12. The voltage drop across the measuring resistor 10 is applied to an input of a comparison circuit 32 which is incorporated in the correction-time member 3 (denoted by a broken line), another input of the said comparison circuit being supplied with an increasing signal which is generated by a generator 31 as soon as the latter is started by the switch-on pulse arriving on line 7 so as to start the exposure. As soon as the amplitude of the increasing signal becomes equal to the amplitude of the signal proportional to the tube current, the comparison circuit 32 supplies the start pulse for the gate circuit 2.

By superimposition of the constant direct voltage, it can then be achieved that the delay time $T_d$ of the start pulse with respect to the switch-on pulse is composed of a constant amount $T_c$ and an amount which is proportional to the current, so that the following formula can be established:

$$T_d = T_c + T.I/I_0,$$

in which T is a constant time, I is the measured current and $I_0$ is a reference current. It was found that this delay time very closely approximates the delay of the high voltage on the X-ray tube and hence of the radiation caused by the primary voltage.

FIG. 3 shows that the increasing voltage reaches the value of the voltage proportional to the tube current ($I_1$, $I_2$, $I_3$) before the tube current reaches its stable final value. This produces a time error which can be corrected in that the increasing voltage does not exactly linearly increase but according to an *e*-function, so it corresponds to the variation in time of the voltage on a capacitor which is charged by a direct voltage source via a constant resistance.

What is claimed is:

1. A time-measuring device for an x-ray generator of the type including a high voltage transformer for supplying anode current to an x-ray tube, a switch connected in the transformer primary circuit and an automatic exposure device for determining the radiation dose of an irradiated body comprising, means for effectively measuring time intervals, and means responsive to a switch-on pulse for the x-ray generator for effectively reducing the time interval measured by said time measuring means by an amount which varies with the anode current of the x-ray tube.

2. A time-measuring device as claimed in claim 1 wherein said time measuring means is started by a start pulse and is stopped by a switch-off pulse so as to terminate the x-ray exposure, and said means for reducing the time interval measured comprises a time delay unit which generates a start pulse for the time measuring means which is delayed with respect to the switch-on pulse for the x-ray exposure by a period of time which is dependent on the tube current.

3. A time-measuring device as claimed in claim 2 wherein the x-ray generator includes means for adjusting the x-ray tube anode current and the time delay unit comprises at least one time-determining resistor, the value of which can be adjusted by the adjusting means for the tube anode current.

4. A time-measuring device as claimed in claim 2 wherein the time delay unit comprises a signal generator which is responsive to the switch-on pulse to produce an increasing signal, the start pulse for the time measuring means being generated as soon as the amplitude of said increasing signal equals the amplitude of a signal proportional to the anode tube current.

5. A time-measuring device as claimed in claim 4 wherein said signal generator includes means for producing a direct voltage that is superimposed on the increasing signal.

6. A time-measuring device as claimed in claim 4 wherein the signal generator produces an increasing signal that has an exponential curvature.

7. A time-measuring device as claimed in claim 2 wherein the time-measuring means controls a display unit.

8. A time-measuring device for an x-ray system of the type including a high voltage transformer for supplying anode current to an x-ray tube and a switching element connected in the transformer primary circuit and responsive to a switch-on pulse for initiating an x-ray exposure, said device comprising, means for measuring time, a time delay unit responsive to the switch-on pulse for producing a delayed start pulse delayed for a period of time which is dependent on the x-ray tube anode current, means for applying the delayed start pulse to the time-measuring means to initiate a timing operation, an automatic exposure device for generating a switch-off pulse to terminate an x-ray exposure, and means for coupling the switch-off pulse to said time-measuring means to terminate the timing operation.

9. A time-measuring device as claimed in claim 8 wherein said time-delay unit comprises a signal generator for generating an increasing signal in response to the switch-on pulse and a comparison device having a first input coupled to said signal generator and a second input, means for deriving a control voltage that is proportional to the x-ray tube anode current, and means for applying the control voltage to said second input of the comparison device.

10. A time-measuring device as claimed in claim 8 wherein said time measuring means comprises, a counter, a pulse generator, a gate circuit having an output coupled to a counter input and first, second and third inputs coupled to the pulse generator, the time delay unit and the automatic exposure device, respectively.

* * * * *